US008624511B2

(12) United States Patent
Cavallini et al.

(10) Patent No.: US 8,624,511 B2
(45) Date of Patent: Jan. 7, 2014

(54) METHOD FOR OPTIMIZING EFFICIENCY VERSUS LOAD CURRENT IN AN INDUCTIVE BOOST CONVERTER FOR WHITE LED DRIVING

(75) Inventors: Pier Cavallini, Swindon (GB); Louis DeMarco, Swindon (GB); Adil Sabihi, Swindon (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 68 days.

(21) Appl. No.: 13/441,070

(22) Filed: Apr. 6, 2012

(65) Prior Publication Data

US 2013/0249421 A1 Sep. 26, 2013

(30) Foreign Application Priority Data

Mar. 24, 2012 (EP) ..... 12002094

(51) Int. Cl.
*H05B 33/08* (2006.01)

(52) U.S. Cl.
USPC ..... 315/189; 315/193

(58) Field of Classification Search
None
See application file for complete search history.

(56) References Cited

U.S. PATENT DOCUMENTS

| | | | | |
|---|---|---|---|---|
| 7,187,136 | B2 * | 3/2007 | Fiorello | 315/224 |
| 7,236,046 | B2 | 6/2007 | Georgescu et al. | |
| 7,449,844 | B2 * | 11/2008 | Lev et al. | 315/291 |
| 7,463,236 | B2 | 12/2008 | Kawai et al. | |
| 7,579,786 | B2 * | 8/2009 | Soos | 315/291 |
| 7,893,674 | B2 * | 2/2011 | Mok et al. | 323/283 |
| 8,049,439 | B2 * | 11/2011 | Zhao et al. | 315/297 |
| 8,115,419 | B2 * | 2/2012 | Given et al. | 315/307 |
| 8,310,171 | B2 * | 11/2012 | Reisenauer et al. | 315/287 |
| 8,373,346 | B2 * | 2/2013 | Hoogzaad et al. | 315/185 R |
| 8,421,372 | B2 * | 4/2013 | Myers et al. | 315/291 |
| 2005/0035729 | A1 * | 2/2005 | Lev et al. | 315/291 |
| 2006/0139193 | A1 | 6/2006 | Morrow et al. | |
| 2008/0001547 | A1 * | 1/2008 | Negru | 315/189 |
| 2008/0068066 | A1 | 3/2008 | Mittal | |
| 2009/0134855 | A1 | 5/2009 | Landwehr | |
| 2010/0207536 | A1 * | 8/2010 | Burdalski et al. | 315/224 |
| 2010/0244799 | A1 | 9/2010 | Moussaoui | |
| 2011/0115399 | A1 * | 5/2011 | Sadwick et al. | 315/287 |
| 2011/0254454 | A1 * | 10/2011 | Inoue et al. | 315/161 |

(Continued)

FOREIGN PATENT DOCUMENTS

WO WO 2011/021075 2/2011

OTHER PUBLICATIONS

European Search Report 12002094.6-1239, Maile date—Sep. 19, 2012.

*Primary Examiner* — Crystal L Hammond
(74) *Attorney, Agent, or Firm* — Saile Ackerman LLC; Stephen B. Ackerman

(57) ABSTRACT

Circuits and methods to achieve a most efficient driver for white LEDs are disclosed. Switching Losses associated with the switching activity of a boost converter and mainly depending on clock frequency and total capacitance at the switching nodes and conduction losses associated with the current flowing in the boost converter and mainly depending on the series resistance of the elements in the regulation loop are minimized by using a size programmable NFET power switch with constant current limit, a very low voltage and accurate programmable current source, a programmable reference voltage for the error amplifier, and a PWM generator with programmable clock frequency. A limited number of configuration windows corresponding to a set of programmable values (OTP registers) for specific ranges of the current fed to the WLEDs.

28 Claims, 6 Drawing Sheets

(56) References Cited

U.S. PATENT DOCUMENTS

2011/0273095 A1* 11/2011 Myers et al. ..... 315/119
2012/0062149 A1 3/2012 Lin
2012/0098442 A1* 4/2012 Jin ..... 315/188
2012/0187845 A1* 7/2012 Saes et al. ..... 315/113
2012/0299500 A1* 11/2012 Sadwick et al. ..... 315/224

* cited by examiner

| Configuration window | iDAC | Vref[V] | NFET[%] | Clk [MHz] |
|---|---|---|---|---|
| W1 | 0 ⟶ iDAC1 | Vref1 | NFET1% | Clk1 |
| W2 | iDAC1 ⟶ iDAC2 | Vref2 | NFET2% | Clk2 |
| W2 | iDAC2 ⟶ iDAC3 | Vref3 | NFET3% | Clk3 |
| W3 | iDAC3 ⟶ 25mA | Vref4 | 100% | 1MHz |

METHOD FOR OPTIMIZING EFFICIENCY VERSUS LOAD CURRENT IN AN INDUCTIVE BOOST CONVERTER FOR WHITE LED DRIVING

BACKGROUND (1) Technical Field

This disclosure relates generally to the field of white LED drivers and relates more specifically to white LED drivers with improved efficiency.

(2) Background

White light emitting diodes (WLED) are used most often in notebooks and desktop screens, and in virtually all mobile LCD screens. A WLED is typically a blue LED with broad-spectrum yellow phosphor to give the impression of white light. WLEDs are often used for backlighting LCD displays. For such an application WLED drivers have to generate constant current required for a constant luminance.

Charge pumps or inductive converters are usually used as WLED drivers, generating high bias voltages from a single low-voltage supply, such as a battery.

It is a challenge for engineers designing WLED drivers to optimize efficiency of the drivers.

SUMMARY

A principal object of the present disclosure is to optimize the efficiency of a WLED driver.

A further object of the disclosure is to minimize switching losses associated with the switching activity of a boost power converter used.

A further object of the disclosure is to minimize conduction losses associated with the current flowing in the boost converter and mainly depending on the resistance of the elements in the regulation loop.

A further object of the disclosure is to reduce to a minimum the regulated voltage at a node between a programmable current source and a string of WLEDs allowing the boost converter working at smaller duty cycles.

A further object of the disclosure is to utilize a very low voltage and accurate programmable current source.

A further object of the disclosure is to use a programmable reference voltage for an error amplifier.

A further object of the disclosure is to use a size programmable NFET power switch with constant current limit for optimization of switching losses and conduction losses.

A further object of the disclosure is to use a PWM generator with programmable clock frequency.

Moreover an object of the disclosure is to maximize efficiency of the WLED driver in a region where the boost converter is operating in Discontinuous mode.

In accordance with the objects of this disclosure a method to optimize efficiency of white LED driver has been achieved. The method disclosed comprises, firstly, the following steps: (1) providing a device comprising an arrangement of one or more LEDs in series, a programmable iDAC current source, a boost converter comprising a size programmable power switch, a PWM generator with programmable clock frequency, and a programmable reference voltage generator for an error amplifier stage, (2) identifying a number of configuration windows specifying configuration of the LED driver and mode of modulation, wherein the configuration windows and modulation mode depend on current iDAC required through the LED arrangement, and (3) defining clock frequency, size of power switch and said programmable reference voltage once the current iDAC is known. Furthermore the method disclosed comprises (4) storing characteristics of all configuration windows selected, and (5) implementing configuration of a specific LED driver for a specific LED arrangement according to the corresponding configuration window providing optimum efficiency in regard of correspondent characteristics.

In accordance with the objects of this disclosure a circuit for a LED driver having optimized efficiency has been disclosed. The circuit disclosed comprises, firstly, a digital core comprising: a current selection block to select a current generated by a programmable current source, an OTP memory to store profiles of operation windows, a digital comparator, and a means for a frequency divider, wherein an output of the digital block comprises a digital word prog setting a selected value of the current generated by the programmable current source, a clock signal driving a PWM generator, a reference voltage for a regulation loop, and a size of a size programmable power switch of a boost converter. Furthermore the circuit disclosed comprises the boost converter comprising: a port for an input voltage, an inductor connected between a first terminal of the port for the input voltage and a node LX, and a rectifying means connected between the node LX and an output voltage of the boost converter. Furthermore the boost converter disclosed comprises: a capacitor connected between output ports of the boost converter, said size programmable power switch connected between the node LX and a second terminal of a sense resistor, wherein the power switch is controlled by a signal from a regulation loop, said sense resistor, wherein a second terminal of the sense resistor is connected to a second terminal of said port for the input voltage, said PWM generator driving via said regulation loop the power switch, wherein the PWM generator receives said clock signal, and said regulation loop to control an output voltage an output voltage of the programmable current source using said reference voltage, being connected between a second terminal of a programmable current source and a gate of said power switch. Moreover the driver disclosed comprises: one or more LEDs connected in series wherein a first terminal of the one or more LEDs is connected to a first output port of the boost converter and a second terminal of the one or more LEDs is connected to the second terminal of the programmable current source, and said programmable current source to deliver a bias current to the one or more LEDs, wherein a second terminal of the current source is connected to the second terminal of said port for the input voltage.

BRIEF DESCRIPTION OF THE DRAWINGS

In the accompanying drawings forming a material part of this description, there is shown.

DESCRIPTION OF THE PREFERRED EMBODIMENTS

Methods and circuits for driving white LEDs (WLED) are disclosed. In a preferred embodiment a string of WLEDS is powered by the driver, e.g. for backlighting a display LCD.

It should be noted that the methods and circuits disclosed could be used for any LED drivers based on inductive boost converter.

Figure 1:
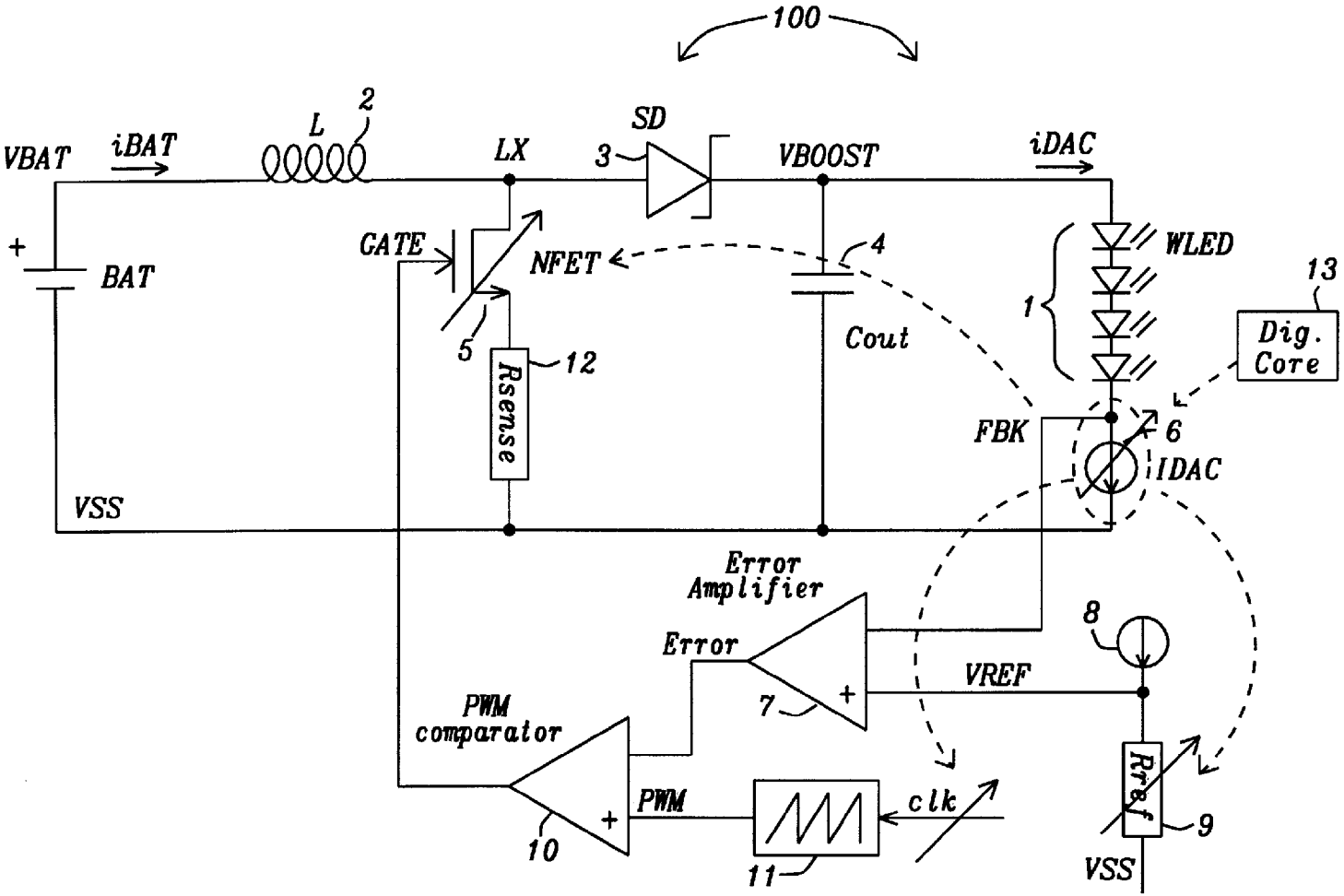
FIG. 1 shows a basic block diagram of a first embodiment of a high-voltage WLED boost converter disclosed.

FIG. 1 shows a basic block diagram of a first embodiment of a high-voltage WLED boost converter disclosed. The circuit of FIG. 1 comprises a string of external WLEDs 1 connected between an output voltage of a boost converter VBOOST and a node FBK, an external inductor L 2 connected between battery (VBAT) and node LX, an external Schottky diode SD 3 connected between LX and the boosted voltage VBOOST, an external capacitor Cout 4 connected to the boosted voltage VBOOST, an integrated power switch NFET device 5 controlled by the signal GATE, a sense resistor 12 for current sensing, an integrated programmable current source IDAC 6 to bias the string of WLED 1, and an integrated regulation loop. In the example of FIG. 1 a string of 4 WLEDs 1 is shown, it should be noted that the instant disclosure applies also to one WLED or any number of WLEDs.

Furthermore FIG. 1 shows a digital core 13. The entire selection process of most efficient operation regions is done by the digital core 13, controlling the boost converter 100 configuration. The functions of the digital core 13 will be explained later and illustrated in FIG. 3*b*. It should be noted that the digital core 13 can be either implemented integrated in the boost converter or externally to the boost converter.

The status of the programmable IDAC 6 is used to know the load current and get a specific profile of for the boost voltage. It should be noted that the principle of the disclosure can be used to any system that uses the same approach as the disclosure to drive any LEDs.

The integrated regulation loop comprises an error amplifier EA 7 with fixed voltage gain, a programmable voltage reference generator 8 of one fixed current source and variable resistor Rref 9, a PWM comparator 10, and a saw tooth generator (PWM) 11 with programmable clock (clk) frequency.

The efficiency of the WLED system 100 can be defined by the ratio:

$$\eta = Pout/Pin, \tag{1}$$

in other words the relation between output power and input power, wherein $$Pout = (VBOOST - FBK) \times iDAC, \text{and} \tag{2}$$

$$Pin = VBAT \times iBAT. \tag{3}$$

Equation (2) is valid for a single string of WLEDs. For 2 or more (K) strings:

$$Pout = \sum_{K} (VBOOST - FBK_K) \times iDAC_K \tag{4}$$

As Pout is the result of the luminance required by WLED 1, in order to maximize efficiency it is mandatory to reduce Pin or more specifically the losses.

The losses can be categorized as:

- Switching Losses (SLoss): associated with the switching activity of the boost and mainly depending on clk and total capacitance at the switching nodes, and
- Conduction Losses (CLoss): associated with the current flowing in the boost and mainly depending on the series resistance of the elements in the regulation loop.

Since, as a general rule, switching losses SLoss become dominant at low load currents and the information of the output current required (iDAC) is always available, it makes sense to configure the boost in such a way it can operate always under the most efficient conditions.

The disclosed configurable solution is to address three areas where losses can be reduced:

- The first step to achieve good efficiency is to be able to reduce to a minimum the regulated voltage at FBK. A lower value of FBK allows to regulate VBOOST lower (according to Eq. 1), making the boost converter working at a lower Duty Cycle and saving in CLoss as explained in Eq. 5:

$$\text{Duty cycle} = 1 - (VBAT \times \eta)/VBOOST; \tag{5}$$

In the analysis of the sources of CLoss and SLoss a large contribution is due to the power switch NFET 5:

- A large NFET will have a small On-Resistance for small CLoss;
- A small NFET will have a small parasitic capacitance (in particular at the LX node) for small SLoss;
- A large clk frequency improves load regulation but increases SLoss;

As it will be explained later in this document, the different configurations for the boost will be defined by the programmed load current iDAC via digital control and stored in OTP registers during the trimming phase of the device.

FIG. 1 illustrates the principle of the configurable boost (dotted traces):

- The current in the IDAC block (iDAC) 6 is programmed in steps between 0 and 25 mA e.g. in logarithmic sequence with a resolution (number of bits) defined by an application; and
- The programming word for prog iDAC is used to set:
  - The tap point for the Rref 9 which defines the reference voltage Vref for the Error Amplifier EA 7;
  - The scale factor for the power switch NFET 5;
  - The clock frequency of the PWM signal clk.

The iDAC selection is an N-bits word to identify any of the 2 power of N levels of current for the WLED string (logarithmic scale). This N-bits word is the programming word "prog". The digital comparator 32 reads "prog" and identifies the correspondent window for clk, vref and NFET.

In applications as e.g. backlight systems the IDAC current is programmed in logarithmic steps in order to compensate for human eye response.

Figure 3A:
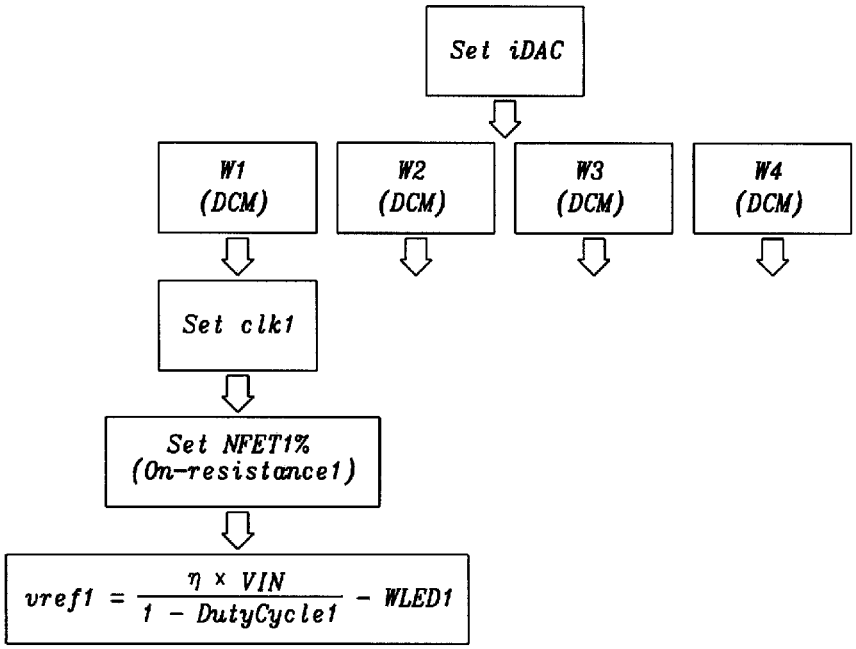
FIG. 3*a* illustrates a process to define the reference voltage for regulation.
Figure 3B:
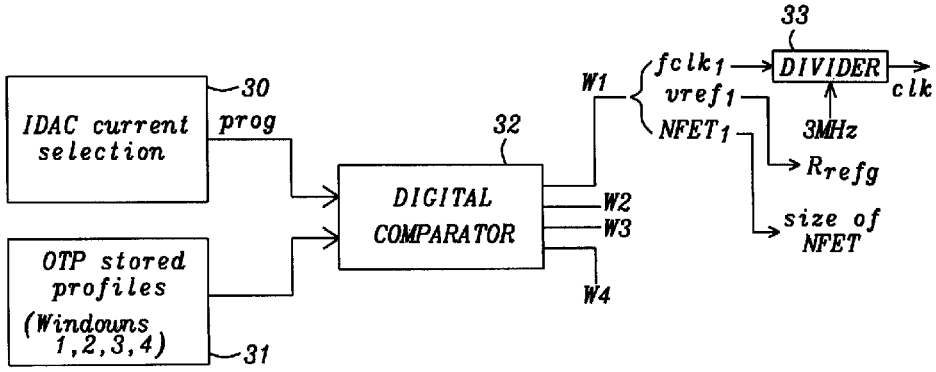
FIG. 3*b* depicts a block diagram of a digital core selecting a profile of the driver dependent on the different operating windows.

As shown in FIG. 3*b*, in order to simplify the process, a limited number of configuration windows are defined corresponding to a set of programmable values (OTP registers) for specific ranges of iDAC.

For this implementation, as non-limiting example, 4 different configuration windows (W1, W2, W3 and W4) have been identified, each covering an iDAC current range that can be extended or reduced at user's wish.

Figure 2:
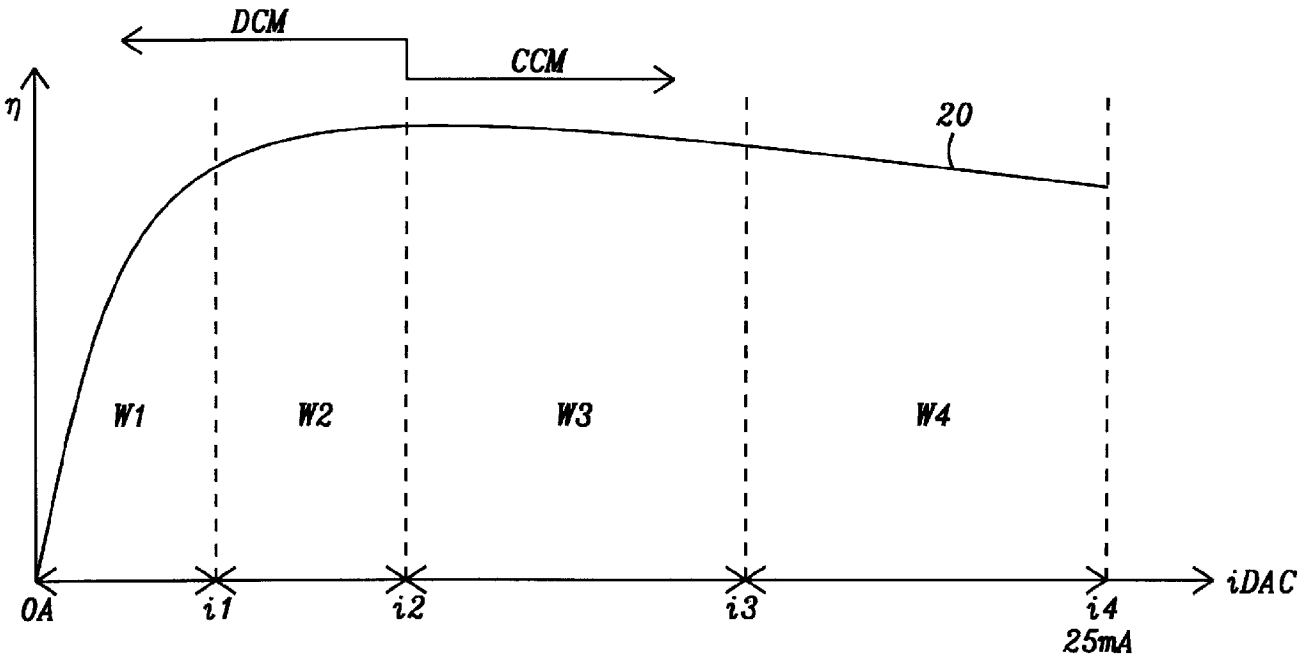
FIG. 2 shows a chart of Configuration windows vs. iDAC

FIG. 2 shows a chart of configuration windows and efficiency vs. iDAC current. It illustrates how the implementation will look like in respect to an efficiency curve 20 vs. IDAC. The table below is a representation of the different configurations. Depending on the resolution required for each variable, a certain number of OTP registers are required. It shows that the efficiency η has reached between configuration windows W2 and W3 its maximum.

In windows W1-W2 the boost converter operates in DCM mode. In windows W3-W4 the boost converter operates in CCM mode. A purpose of the design in the disclosure presented is to maximize efficiency in a region where the boost converter is operating in DCM mode. Therefore, as shown in FIG. 2, the optimum efficiency is reached in window W2. In this region the switching losses as well as the conduction losses can be relevant at different degrees; hence there is a need to adapt the profile (WLED, NFET power switch, clk) in order to minimize losses.

A small hysteresis (also user programmable) guarantees smooth transitions between windows during the ramp up/down of the iDAC current (from 0 to 25 mA and vice versa) through all the iDAC programming codes.

As shown in FIG. 2, the boundaries of the configuration windows W1-W4 are such that the border between Discontinuous and Continuous Conduction Modes (DCM and CCM) would approximately always be in correspondence to one of them.

The way the VBOOST and FBK voltages, as shown in FIG. 1, are regulated depends on the boost's operating mode. In DCM the Duty Cycle depends on the load current (assuming no losses) and its expression differs from the one used in CCM; therefore the expression used to estimate the reference voltage VREF to be programmed in order to achieve a certain value of FBK will change.

$$FBK=f(\text{clk,On-Resistance,Duty Cycle}); \quad (6)$$

$$\text{Duty Cycle } DCM=f(VBAT,VBOOST,iDAC); \quad (7)$$

$$\text{Duty Cycle } CCM=f(VBAT,VBOOST); \quad (8)$$

The procedure steps to define the reference voltage VREF for the error amplifier EA 7 is described in the FIG. 3*a*:

- Once the current iDAC is set and the corresponding configuration window identified, clock frequency clk and size of power switch NFET are selected according to the CLoss and SLoss to minimize; the mode of operation (DCM or CCM) is also known.
- The information on mode of operation, iDAC, clk and NFET (On-resistance) allows estimating the value of VREF.

It is obvious that for the windows W2-W4 shown in FIG. 3*a* correspondent values of clock frequency clk, size of power switch NFET, and reference voltage VREF are to be set the same way as illustrated for windows W1.

The voltage values for the windows selected as e.g. WLED1, WLED2, WLED3, and WLED4 can be identified during characterization at a testing site and stored in the OTP 31, as shown in FIG. 3*b*. Alternatively formulas to estimate the voltage values of WLED (one for DCM and one for CCM) can also be used and follow the equations (7) and (8).

FIG. 3*b* shows a block diagram of a digital core 13 selecting a profile of the driver dependent on the different operating windows. The digital core 13 comprises a circuit 30 providing as output a digital word prog defining the value of the IDAC current selected. The digital word prog comprises information about a tap point for the reference resistor Rref 9, the scale factor for the power switch NFET 5, and the clock frequency of the PWM signal clk.

The digital programming word "prog" is an N-bit word to define any of the 2 power of N iDAC values between 0 and 25 mA decoded in the example of the preferred embodiment in a logarithmic scale. The iDAC selection block looks like a look-up table with currents vs. digital codes.

Furthermore the digital core 13 comprises an OTP memory 31 containing the profiles of all windows, e.g. in the preferred embodiment the profiles of windows W1-W4. Other numbers of windows are also possible. The digital word prog representing the IDAC current selected and the profile of operation windows are input of a digital comparator 32, i.e. the value of the PWM clock frequency clk, the size of the power switch NFET 5, and the resistance of the reference resistor Rref 9. These values are set by the comparator 32 according the operation window selected dependent on the IDAC current selected. The frequency clk is set via a programmable digital frequency divider 33 using in the preferred embodiment a base frequency of e.g. 3 MHz. Other base frequencies can be used as well.

Figure 4A:
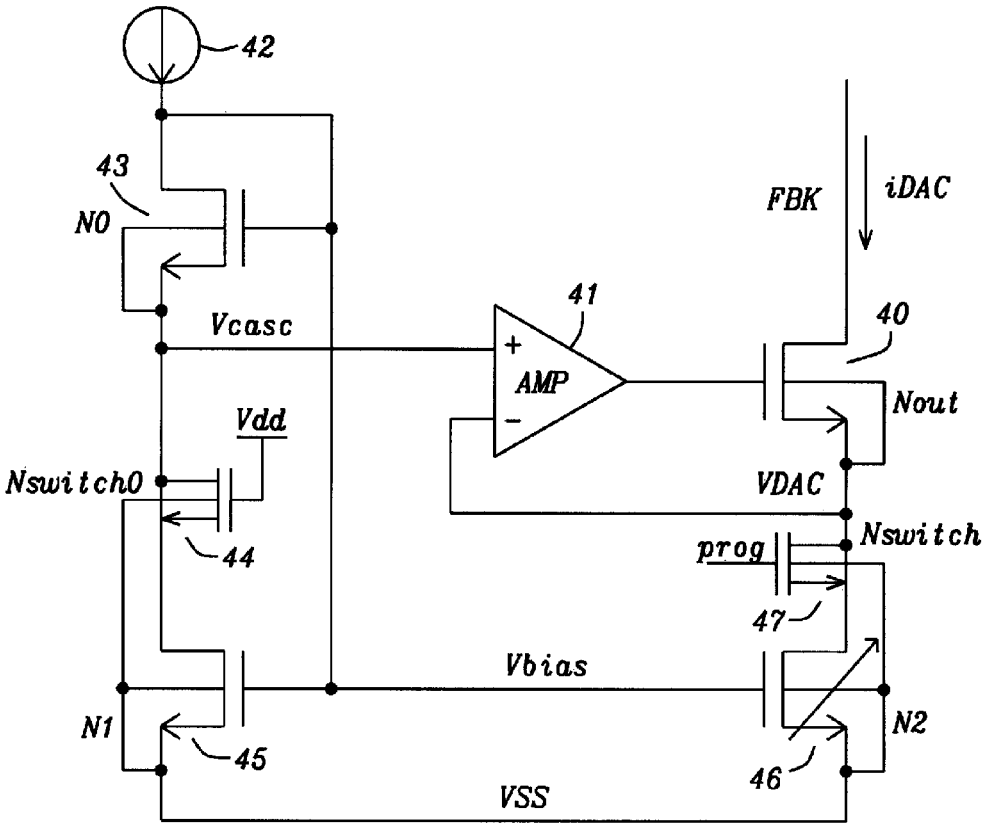
FIG. 4*a* presents a detailed circuitry of the programmable current source Idac providing current for the LEDs.

The next FIG. 4*a* presents the programmable current source IDAC 6 implemented in this system. It is a regulated current source that guarantees a very accurate output current and allows to operate with a very low FBK voltage (<150mV typically for iDAC up to a current of 25 mA or higher).

The circuit of FIG. 4*a* comprises a reference branch comprising the current source 42, providing constant current, transistor N0 43, transistor switch Nswitch0 44 and transistor N1 45. The reference branch generates Vcasc voltage. The Nswitch0 44 replicates the voltage drop on the output branch due to the selection switch Nswitch 47.

The output branch comprises transistor N2 46, transistor Nswitch 47 and output transistor Nout 40. The transistor NOUT 40 delivers the output current IDAC. Amplifier 41 controls the gate of transistor NOUT 40. The amplifier 41 together with transistor NOUT 40 provides a regulation that guarantees voltage Vdac equals voltage Vcasc. The size of transistors N1 and N2 is such that the saturation operation is guaranteed for very low drain-source voltages (<150 mV) and is the most important element to achieve efficiency of the boost operation.

Transistors N2 46 and N1 45 form a current mirror. The gate of transistor NSWITCH 47 is controlled by a voltage corresponding to a digital word prog, which is used to select the IDAC current. The adjustment of the transistor N2 46 via Nswitch 47 can be performed by e.g. by logarithmic steps or in another sequence.

There are actually a number of N2 devices in parallel, each with an Nswitch device on top. To increase the mirroring ratio, and reach the desired output current, a number of Nswitch devices are closed in sequence. The non-selected branches are with the Nswitch device open therefore that portion of the N2 device does not take part to the conduction. Due to the nature of the logarithmic response, the scaling ratio of the N2 devices is not binary weighted but logarithmic, meaning that for small codes (small currents) the ratio increases at slow rate, while when large codes (large currents) are selected the ratio is larger. Obviously the size of Nswitch device is proportional to the size of the N2 device underneath.

Figure 4B:
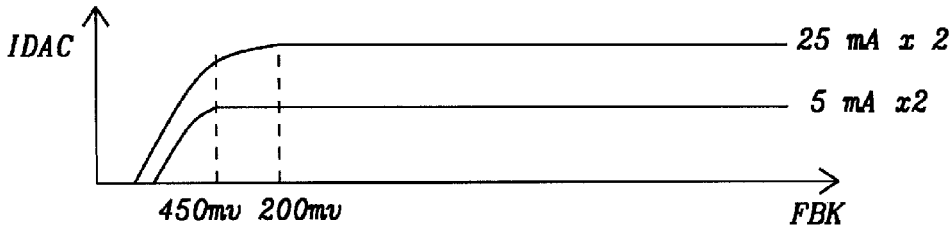
FIG. 4*b* shows a diagram of the output currents of the programmable current source Idac depending on the IDAC output voltage FBK.

FIG. 4*b* shows a diagram of the output currents IDAC of the programmable current source versus the IDAC output voltage FBK. The IDAC values shown are for a maximum case 400 and typical case 401, wherein X2 stands for 2 strings of WLED supported.

The programming of VREF is explained in FIG. 3*a*. As further enhancement of the proposed system, the selection of VREF is linked to the voltage gain (GV) of the Error Amplifier EA 7. The GV can be programmed higher or lower to improve load regulation. The higher GV, the higher is the final regulated FBK voltage hence, if the user decides to opt for a different GV, the system must compensate for it. The proposed implementation is done as such that the range of available VREF values can cover for the range of available GV.

Figure 5:
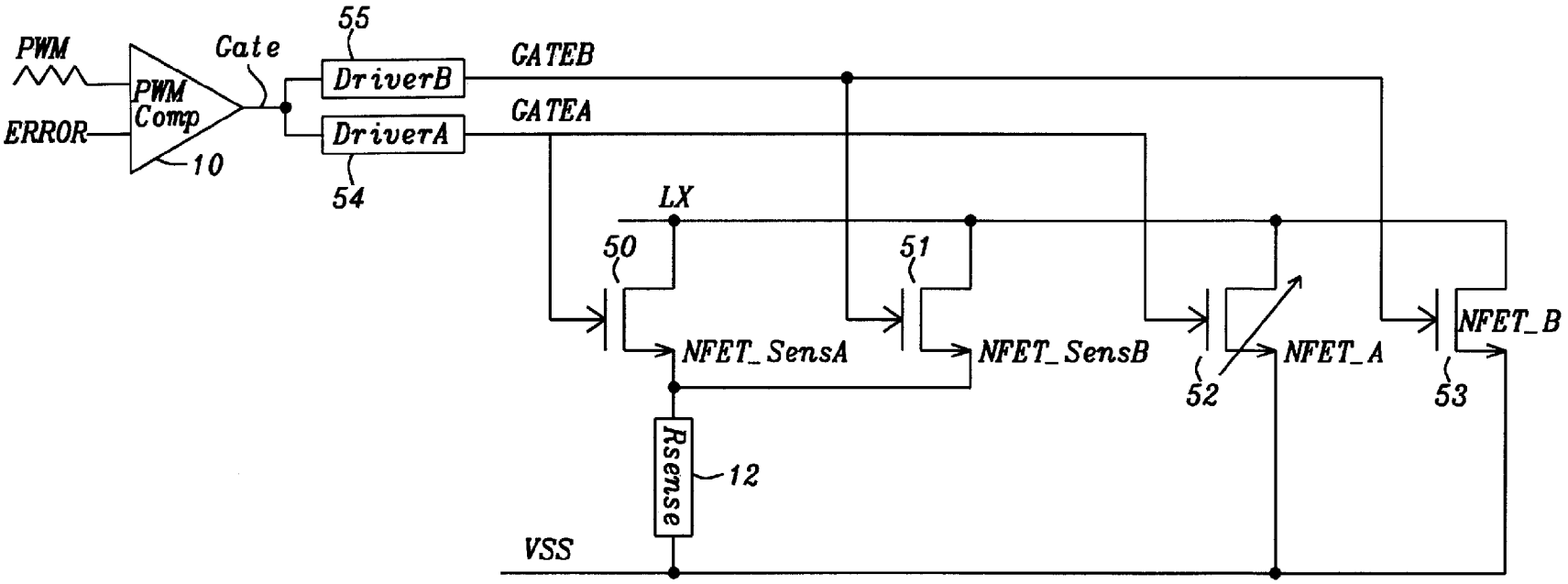
FIG. 5 depicts the configurable power switch system NFET.

FIG. 5 depicts the configurable power switch system NFET 5. FIG. 5 shows how the power switch system NFET 5 is configured. In this non-limiting example there are 3 possible configurations for the NFET:

GATEA active: NFET_A (52) active;

GATEB active: NFET_B (53) active;

GATEA and GATEB active: NFET_A+NFET_B;

FIG. 5 illustrates the PWM comparator 10, as also shown in FIG. 1, driving via driver A 54 and via driver B 55 the programmable power switch comprising in the example of FIG. 5 a first part NFET_A 52 and NFET_B 53. The table below illustrates how the setting of both drivers 54 and 55 activates gate A or Gate B or both.

| | Driver A | Driver B |
|---|---|---|
| Gate A ON | ON | OFF |
| Gate B ON | OFF | ON |
| Gate A + B ON | ON | ON |

The drivers 54 and 55 are simple buffer stages made of a series of MOS inverters (NFET+PFET) in order to scale up the driving strength and cope with the large capacitive load of gate A and gate B. Obviously the driving strength of driver A and B will be proportional to the gate size that they have to drive. When a gate is OFF, the input of the correspondent driver is set constantly to ground, while when a gate is ON, the correspondent driver is left to switch according to the PWM signal. Dedicated logic is used to prevent the overlapping of the rising and falling edges of the drivers and avoid cross conduction (which will cause loss in efficiency).

It should be noted that, as shown in FIG. 5, parallel multiple driving stages can be associated to separate NFET devices in order to scale the pull down capability at the LX node in relation to the output current of the boost converter.

If for instance the ratio between NFET_A (52) and the total NFET area is 40%, the On-Resistance of NFET_A (52) will be 40% higher and the gate to source capacitance, which needs to be charged/discharged at every cycle, to be approximately 40% lower. The NFET_A ratio is used for low load configuration where SLoss dominate with respect to CLoss.

The current sensing (for slope compensation and current limiting) is performed using a scaled version (NFET_SensA 50 and NFET_SensB 51) of the main power switch (hence there is little contribution to the conduction of the boost current from the sense devices), which mirrors the main current into a sense resistor Rsense 12. The main point is that if power switch system NFET 5 changes its size according to current iDAC, the mirroring ratio stays constant hence the current gain (for slope compensation) and current limits (to prevent coil saturation) also remain constant.

The current gain is kept constant in regard of the NFET size selection; hence the following equation is valid:

$$I_{LOAD} \times \text{duty cycle} \times \frac{\text{NFET_sense}}{NFET} \times R_{SENSE} = \text{constant},$$

wherein $I_{LOAD}$ is the current through inductor 2, NFET_SENSE/NFET represents the scale of the size of the scaled versions (50, 51) related to the selected size of the power switch (52, 53) and $R_{SENSE}$ is the resistance of the sense resistor 12.

The switching frequency clk selection is made through a programmable frequency divider for fine steps tuning (5 bits) in the range e.g. between 0.25 and 3 MHz. For low iDAC values, clk is reduced to minimize SLoss; the fine-tuning is needed to optimize the efficiency in respect to NFET and iDAC.

Figure 6:
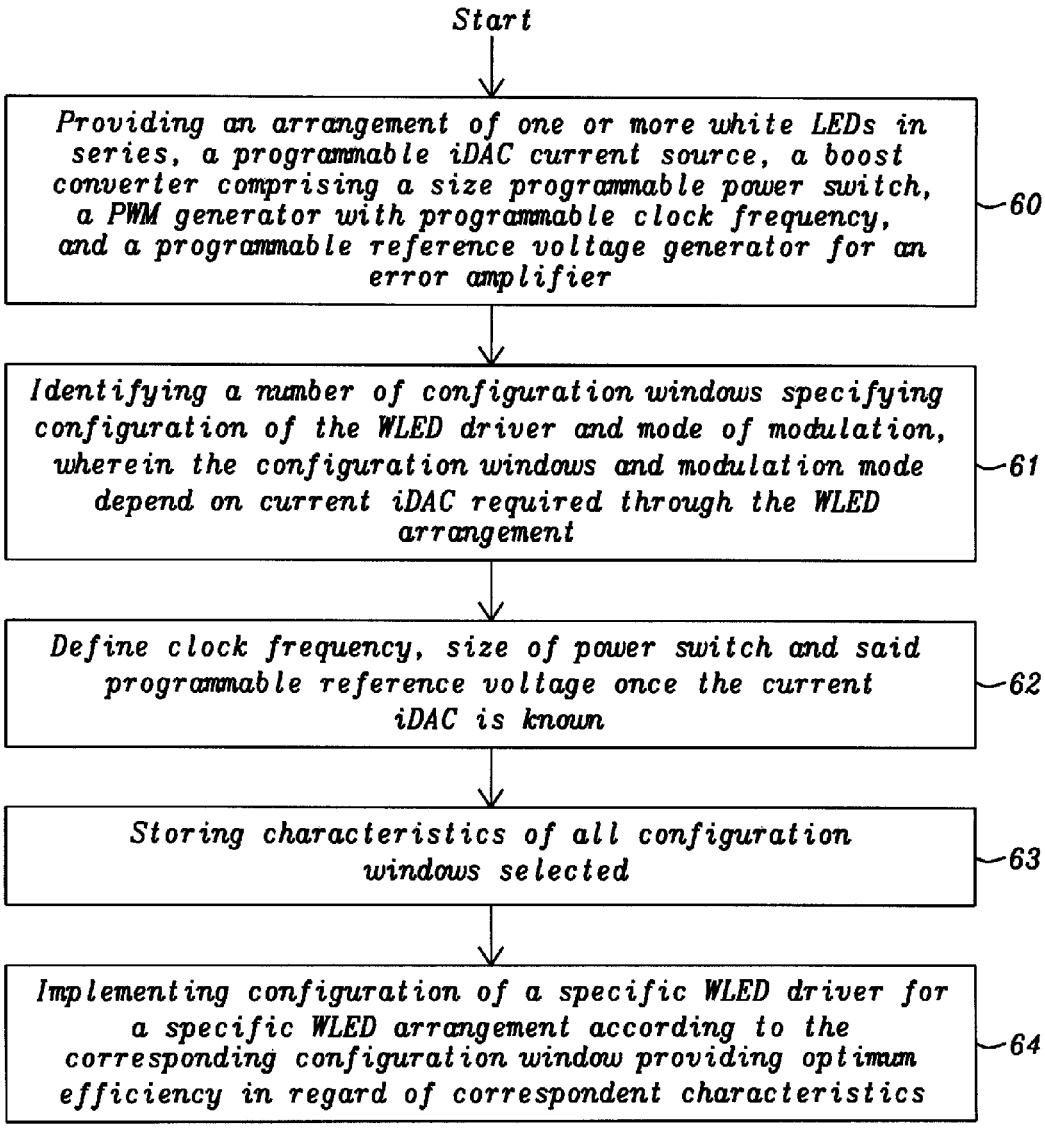
FIG. 6 illustrates a flowchart of a method disclosed to optimize the efficiency of a boost converter for a white LED driver.

FIG. 6 illustrates a flowchart of a method disclosed to optimize the efficiency of a boost converter for a white LED driver. Step 60 of the method of FIG. 6 illustrates the provision of an arrangement of one or more white LEDs in series, a programmable current source, and a boost converter comprising a size programmable power switch, a PWM generator with programmable clock frequency, and a programmable reference voltage generator for an error amplifier stage. Step 61 depicts identifying a number of configuration windows specifying configuration of the WLED driver and mode of modulation, wherein the configuration windows and modulation mode depend on current iDAC required through the WLED arrangement. Step 62 illustrates defining clock frequency, size of power switch and said programmable reference voltage once the current iDAC is known. Step 63 illustrates storing characteristics of all configuration windows selected. Step 64 depicts implementing configuration of a specific WLED driver for a specific WLED arrangement according to the corresponding configuration window providing optimum efficiency in regard of correspondent characteristics.

While the disclosure has been particularly shown and described with reference to the preferred embodiments thereof, it will be understood by those skilled in the art that various changes in form and details may be made without departing from the spirit and scope of the disclosure.

What is claimed is:

1. A method to optimize efficiency of a LED driver, comprising the following steps:

(1) providing a device comprising an arrangement of one or more LEDs in series, a programmable iDAC current source, and a boost converter comprising a size programmable power switch, a PWM generator with programmable clock frequency, and a programmable reference voltage generator for an error amplifier stage;

(2) identifying a number of configuration windows specifying configuration of the LED driver and mode of modulation, wherein the configuration windows and modulation mode depend on current iDAC required through the LED arrangement;

(3) defining clock frequency, size of power switch and said programmable reference voltage once the current iDAC is known;

(4) storing characteristics of all configuration windows selected; and (5) implementing configuration of a specific LED driver for a specific LED arrangement according to the corresponding configuration window providing optimum efficiency in regard of correspondent characteristics.

2. The method of claim 1 wherein said storing of characteristics of all configuration windows selected is performed during a trimming phase of the device.

3. The method of claim 1 wherein four configuration windows are selected each covering a range of iDAC current.

4. The method of claim 1 wherein boundaries of the configuration windows can comprise a border between Discontinuous and Continuous Conduction Modes of the boost converter.

5. The method of claim 1 wherein a curve representing the efficiency of the configuration windows in dependency of the iDAC current required is the basis of defining the ranges of the configuration windows.

6. The method of claim 1 wherein the current generated by the iDAC current source is programmed in steps.

7. The method of claim 6 wherein said steps are programmed in logarithmic sequence in order to compensate for human eye response.

8. The method of claim 1 wherein a programming word for iDAC current source is used to set a tap point for a resistor, which defines the reference voltage for the error amplifier, a scale factor for the power switch, and the clock frequency of the PWM generator.

9. The method of claim 1 wherein a user programmable hysteresis can be set to enable smooth transitions between windows during the ramp up/down of the iDAC current.

10. The method of claim 1 wherein the programmable current source allows generating current with minimal voltage.

11. The method of claim 10 wherein the programmable current source allows a voltage of about 150 mV or lower for delivering a current of e.g. 25 mA or more.

12. The method of claim 1 wherein a method for calculating the programmable reference voltage for the error amplifier comprises the steps of (1) setting iDAC and the correspondent configuration window;

(2) setting clock frequency corresponding to the configuration window selected;

(3) setting size of power switch corresponding to the configuration window selected and hereby defining ON-resistance of the power switch; and (4) calculating VREF according to the equation:

$$VREF = \frac{\eta \times Vin}{1 - dutycycle} - WLED,$$

wherein η is the efficiency of the corresponding configuration window, Vin is the input voltage of the WLED driver, and duty cycle is the duty cycle according to the selected operation mode of the boost converter.

13. The method of claim 1 wherein current sensing of the power switch is performed using a scaled version of the main power switch, wherein the scaled version mirrors the main current into a sense resistor.

14. The method of claim 1 wherein the method is applied for driving white LEDs for backlight applications.

15. A circuit for a LED driver having optimized efficiency, comprising:

a digital core comprising a current selection block to select a current generated by a programmable current source;

an OTP memory to store profiles of operation windows;

a digital comparator; and a means for a frequency divider;

wherein an output of the digital block comprises a digital word prog setting a selected value of the current generated by the programmable current source, a clock signal driving a PWM generator, a reference voltage for a regulation loop, and a size of a size programmable power switch of a boost converter;

said boost converter comprising:

a port for an input voltage;

an inductor connected between a first terminal of the port for the input voltage and anode LX;

a rectifying means connected between the node LX and an output voltage of the boost converter;

a capacitor connected between output ports of the boost converter;

said size programmable power switch connected between the node LX and a second terminal of a sense resistor, wherein the power switch is controlled by a signal from a regulation loop;

said sense resistor, wherein a second terminal of the sense resistor is connected to a second terminal of said port for the input voltage;

said PWM generator driving via said regulation loop said power switch, wherein the PWM generator receives said clock signal;

said regulation loop to control an output voltage of said programmable current source using said reference voltage, being connected between a second terminal of said programmable current source and a gate of said power switch;

one or more LEDs connected in series wherein a first terminal of the one or more LEDs is connected to a first output port of the boost converter and a second terminal of the one or more LEDs is connected to the second terminal of the programmable current source; and said programmable current source to deliver a bias current to the one or more LEDs, wherein a second terminal of the current source is connected to the second terminal of said port for the input voltage.

16. The circuit of claim 15 wherein said rectifying means is a Schottky diode.

17. The circuit of claim 15 wherein said gain stage has a high gain.

18. The circuit of claim 15 wherein said size programmable power switch is a NFET device.

19. The circuit of claim 18 wherein said NFET device comprises:

a first power transistor connected between LX node and VSS, wherein its gate is connected to a first gate signal;

a second power transistor connected between LX node and VSS, wherein its gate is connected to a second gate signal;

a first current sense transistor connected between LX node and a first terminal of a sense resistor, wherein its gate is connected to the first gate signal and the first current sense transistor is a scaled version of the first power transistor;

a second current sense transistor connected between LX node and a first terminal of the sense resistor, wherein its gate is connected to the second gate signal and the second current sense transistor is a scaled version of the second power transistor; and said sense resistor having a second terminal connected to VSS voltage.

20. The circuit of claim 15 wherein said power switch, said programmable current source, and said regulation loop are all integrated in one integrated circuit.

21. The circuit of claim 20 wherein said digital core is also integrated in the integrated circuit.

22. The circuit of claim 15 wherein said LEDs are white LEDs.

23. The circuit of claim 15 wherein said programmable current source comprises a reference branch comprising a constant current source connected to a gate and drain of a first NMOS transistor;

said first NMOS transistor, wherein a source and a bulk is connected to a drain of a second transistor and to a positive input of an amplifier, and said gate is connected to a gate of a third transistor;

said second transistor, wherein a source is connected to the drain of said third transistor, a bulk is connected to a bulk of the third transistor and to a source of the third transistor, and a gate is connected to Vdd voltage; and said third transistor; wherein a gate is connected to a gate of a fourth transistor, a bulk is connected to a source of the third transistor and to a source and bulk of the fourth transistor;

an output branch comprising said fourth transistor, wherein the bulk is connected to a bulk of a size programmable fifth transistor and a drain is connected to a source of the fifth transistor;

said fifth transistor, wherein its gate is connected to the output of said digital core, receiving the digital word setting a value of the output current of the programmable current source and a drain is connected a negative input of the amplifier and to a source and a bulk of an output transistor of the programmable current source; and said output transistor, wherein its drain provides the output current of the programmable current source and its gate is connected to an output of said amplifier; and said amplifier; wherein the amplifier and the output transistor provide a regulation that a voltage level at the positive input of the amplifier equals a voltage level at the source of the output transistor.

24. The circuit of claim 23 wherein the sizes of both the third transistor and fourth transistors are such that a saturation operation is ensured for drain source voltages that are smaller than 150 mill Volt.

25. The circuit of claim 23 wherein there are more than one of said fourth transistors in parallel and each of said fourth transistors have a transistor of the type of the fifth transistor on top.

26. The circuit of claim 25 wherein, in order to increase a mirroring ratio desired, and to reach the desired output current, a number of said fifth transistors are closed in sequence, wherein the fourth transistors having closed fifth transistors on top are non-selected and don't take part in the conduction.

27. The circuit of claim 15 wherein said regulation loop comprises an error amplifier, wherein a negative input is connected to the second terminal of the programmable current source, a positive input is a reference voltage, which is set by a reference voltage generator via said digital word, and the output of the error amplifier is connected to a PWM comparator;

said PWM comparator, wherein a positive input is connected to an out of a PWM pulse generator, and an output is connected to the gate of the power switch;

said PWM pulse generator; wherein an input is a clock frequency, which is set via a frequency divider which is set by said digital word; and said reference voltage generator comprising a current source having a first terminal connected to the positive input of the error amplifier and to a first terminal of a programmable resistor, wherein a second terminal of the programmable resistor is connected to VSS voltage, and wherein said digital word is setting a tap of the programmable resistor in order to select the reference voltage.

28. The circuit of claim 27 wherein said PWM generator is a saw-tooth pulse generator.

* * * * *